US011624223B2

(12) United States Patent
White et al.

(10) Patent No.: US 11,624,223 B2
(45) Date of Patent: Apr. 11, 2023

(54) SIDE-ACCESSIBLE ADJUSTABLE RECEIVER FOR APPLIANCE HINGE

(71) Applicant: Mansfield Engineered Components, Inc., Mansfield, OH (US)

(72) Inventors: Brian S. White, Galion, OH (US); James J. Collene, Bucyrus, OH (US)

(73) Assignee: Mansfield Engineered Components, Inc., Mansfield, OH (US)

( * ) Notice: Subject to any disclaimer, the term of this patent is extended or adjusted under 35 U.S.C. 154(b) by 357 days.

(21) Appl. No.: 16/712,943

(22) Filed: Dec. 12, 2019

(65) Prior Publication Data

US 2020/0263467 A1 Aug. 20, 2020

Related U.S. Application Data

(60) Provisional application No. 62/778,884, filed on Dec. 12, 2018.

(51) Int. Cl.
*E05D 7/04* (2006.01)

(52) U.S. Cl.
CPC ..... *E05D 7/0415* (2013.01); *E05Y 2600/12* (2013.01); *E05Y 2600/314* (2013.01); *E05Y 2800/176* (2013.01); *E05Y 2900/30* (2013.01)

(58) Field of Classification Search
CPC ..... F24C 15/023; F24C 15/02; E05D 7/04; E05D 7/0415; E05D 7/043; E05D 7/0423;
(Continued)

(56) References Cited

U.S. PATENT DOCUMENTS 3,092,097 A 6/1963 Moss
3,132,640 A 5/1964 Chisholm et al.
(Continued)

FOREIGN PATENT DOCUMENTS

DE 2157991 A1 * 5/1973
DE 2937166 A1 * 4/1981
(Continued)

*Primary Examiner* — Emily M Morgan
(74) *Attorney, Agent, or Firm* — Lippes Mathias LLP

(57) ABSTRACT

An adjustable appliance hinge receiver includes a base including spaced-apart first and second lateral walls. A slide body is slidably connected to the base and located between the lateral walls. The slide body slides relative to the base along an adjustment axis. At least one hinge mounting structure is connected to the slide body and is adapted to be engaged by an associated hinge. An adjustment system includes a first inclined ramp connected to the slide body and an adjustment shaft that extends between and that is rotatably supported by the first and second lateral walls of the base. The adjustment shaft is rotatable relative to the base about an axis of rotation. The adjustment system also includes an adjustment member engaged with the adjustment shaft and selectively movable along the axis of rotation in opposite first and second directions in response to rotational movement of the adjustment shaft in opposite first and second rotational directions such that rotation of the adjustment shaft in one of the first and second rotational directions causes the adjustment member to bear against the first ramp and induce sliding movement of the slide body relative to the base along the adjustment axis.

16 Claims, 15 Drawing Sheets

(58) Field of Classification Search
CPC .... E05D 2007/0461; E05D 2007/0476; E05D 2007/0469; E05Y 2900/308
See application file for complete search history.

(56) References Cited

U.S. PATENT DOCUMENTS

| | | | | |
|---|---|---|---|---|
| 4,021,968 | A | 5/1977 | Kendall | |
| 7,150,071 | B2 * | 12/2006 | Collene | E05D 3/022 126/192 |
| 7,516,517 | B2 | 4/2009 | Fries | |
| 8,307,504 | B2 | 11/2012 | Collene | |
| 8,683,653 | B2 | 4/2014 | Bettinzoli | |
| 9,074,404 | B2 | 7/2015 | DeLozier et al. | |
| 9,404,299 | B2 * | 8/2016 | Braden | E05D 7/0423 |
| 10,145,157 | B2 * | 12/2018 | White | E05F 5/06 |
| 10,704,307 | B1 * | 7/2020 | Collene | E05D 5/02 |
| 2003/0172920 | A1 | 9/2003 | Gronbach | |
| 2004/0172787 | A1 * | 9/2004 | Collene | E05F 5/06 16/289 |
| 2010/0212112 | A1 | 8/2010 | Steurer et al. | |
| 2014/0109344 | A1 | 4/2014 | Lee | |
| 2014/0208542 | A1 * | 7/2014 | White | E05D 7/12 16/261 |
| 2020/0263467 | A1 * | 8/2020 | White | E05D 7/0415 |

FOREIGN PATENT DOCUMENTS

| | | | | |
|---|---|---|---|---|
| GB | 2596336 | A * | 12/2021 | E05D 7/0054 |
| KR | 101230227 | B1 * | 2/2013 | |

* cited by examiner

SIDE-ACCESSIBLE ADJUSTABLE RECEIVER FOR APPLIANCE HINGE

CROSS-REFERENCE TO RELATED APPLICATION

This application claims priority from and benefit of the filing date of U.S. provisional application Ser. No. 62/778,884 filed Dec. 12, 2018 and the entire disclosure of said provisional application is hereby expressly incorporated by reference into the present specification.

BACKGROUND

Appliances such as ovens, dryers, dishwashers, and the like typically include a pair of hinge receivers connected to a front wall or other part of an appliance body, and a door of the appliance is pivotally connected to the appliance body by a corresponding pair of hinges that are connected to the door and that are also engaged with the respective receivers. In certain applications and circumstances, it is desirable to adjust the operative position of the hinge (and door connected thereto) relative to the appliance body without repositioning a base of the hinge receiver relative to the body. This adjustment is sometimes accomplished by an "adjustable receiver" in which the base of the receiver is connected to the appliance body in a fixed location, and one or more internal hinge engagement or hinge mounting structure(s) of the receiver are selectively adjustable relative to the base of the receiver.

In one such system, the receiver base is mounted to a vertical front wall of an oven and the vertical position of the oven door is adjusted by selectively altering the vertical position of one or more horizontal mounting rivets or other hinge mounting structures connected to the receiver base using an adjustment screw that is manually rotated by a user in clockwise or counterclockwise directions. The adjustable screw is located adjacent the front wall of the appliance body, which necessitates opening the appliance door (and/or a drawer located beneath the door) at least partially in order to rotate the adjustment screw as needed to adjust the position of the door. This has been deemed suboptimal because it requires repeated opening and closing of the door to assess the progress of the door adjustable process. Additionally, when adjusting the oven door position downward, known receivers can stick or jamb since they operate by gravity and do not include any active mechanism for forcing the movable part of the assembly downward. As such, when stuck in position, these known receivers require jostling or removal of the door to allow gravity and/or user manual force to lower the movable inner part of the receiver to which the door is connected. Accordingly, a need has been identified for a new and improved adjustable hinge receiver that overcomes this deficiency while providing other benefits and advantages as set forth below.

SUMMARY

In accordance with one aspect of the present disclosure, an adjustable appliance hinge receiver includes a base including spaced-apart first and second lateral walls. A slide body is slidably connected to the base and located between the lateral walls of the base. The slide body is adapted to slide relative to said base along an adjustment axis. At least one hinge mounting structure is connected to the slide body and adapted to be engaged by an associated hinge. An adjustment system includes a first inclined ramp connected to the slide body. The adjustment system includes an adjustment shaft extending between and rotatably supported by the first and second side walls of the base. The adjustment shaft is rotatable relative to said base about an axis of rotation. The adjustment system also includes an adjustment member engaged with the adjustment shaft and selectively movable axially along the axis of rotation in opposite first and second directions in response to rotational movement of the adjustment shaft about the axis of rotation in opposite first and second rotational directions such that rotation of the adjustment shaft in one of the first and second rotational directions causes the adjustment member to bear against the first ramp and induce sliding movement of the slide body relative to the base along said adjustment axis.

DETAILED DESCRIPTION

Figure 1B:
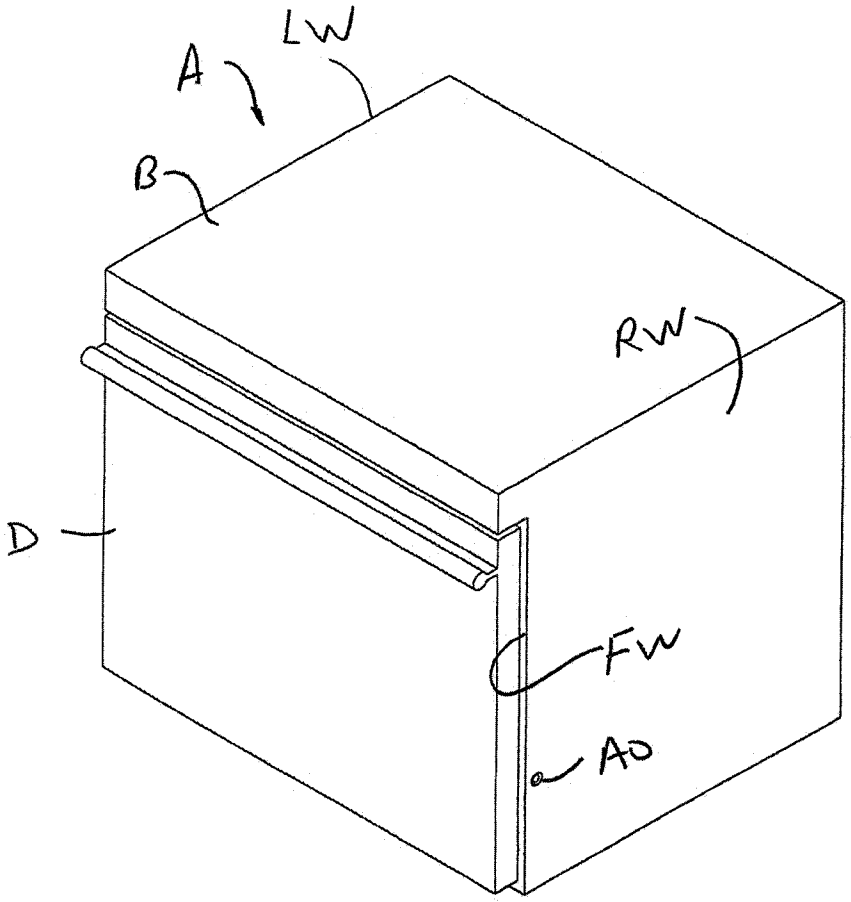
FIGS. 1A & 1B are left and right isometric views of an appliance including a body and a door.
Figure 1A:
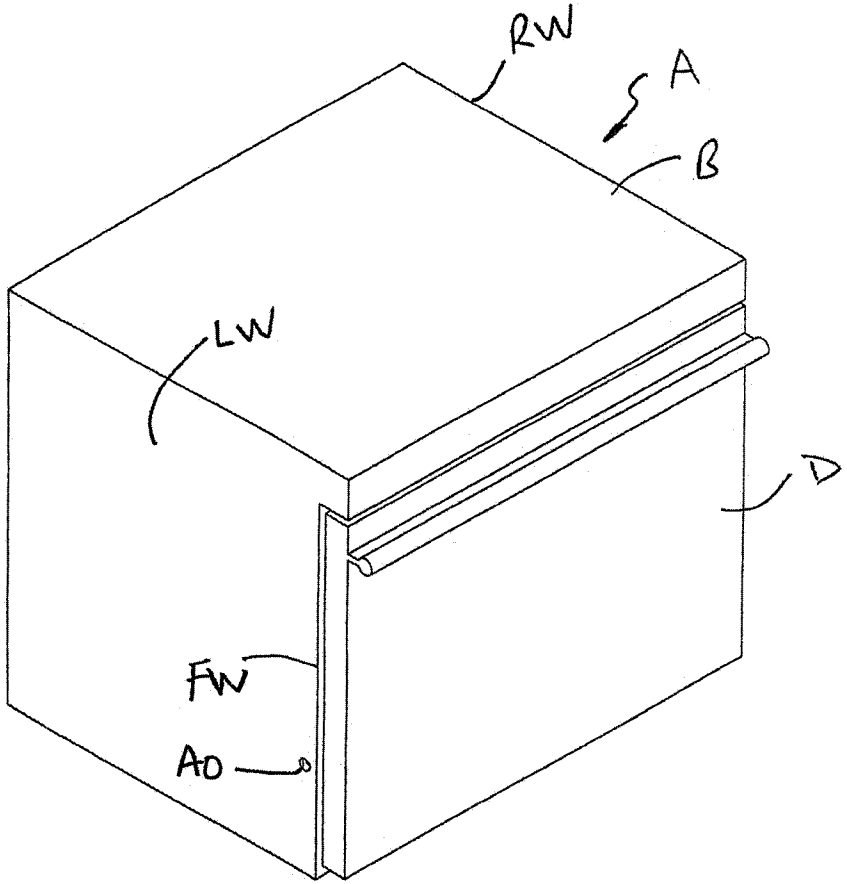
Figure 2B:
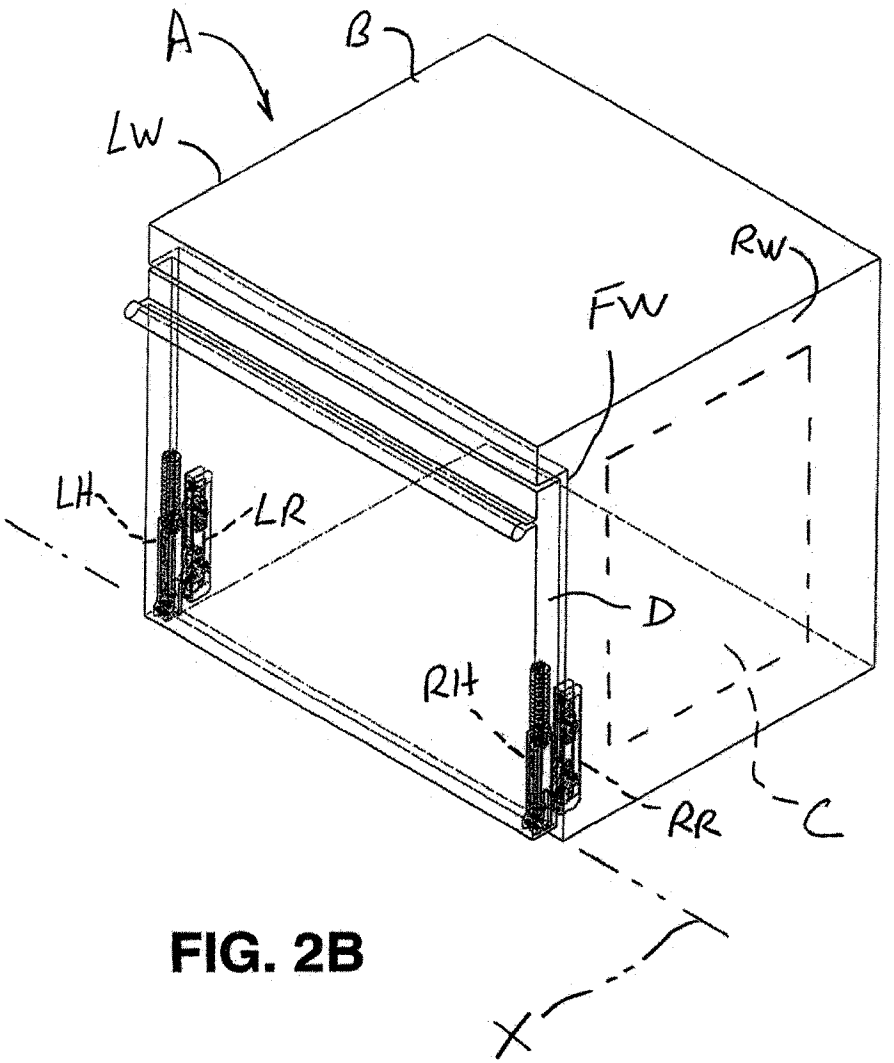
FIGS. 2A & 2B correspond respectively to FIGS. 1A & 1B but also use broken lines to show left and right hinge assemblies connected to the door and that are respectively mated with left and right adjustable hinge receivers connected to the body.
Figure 2A:
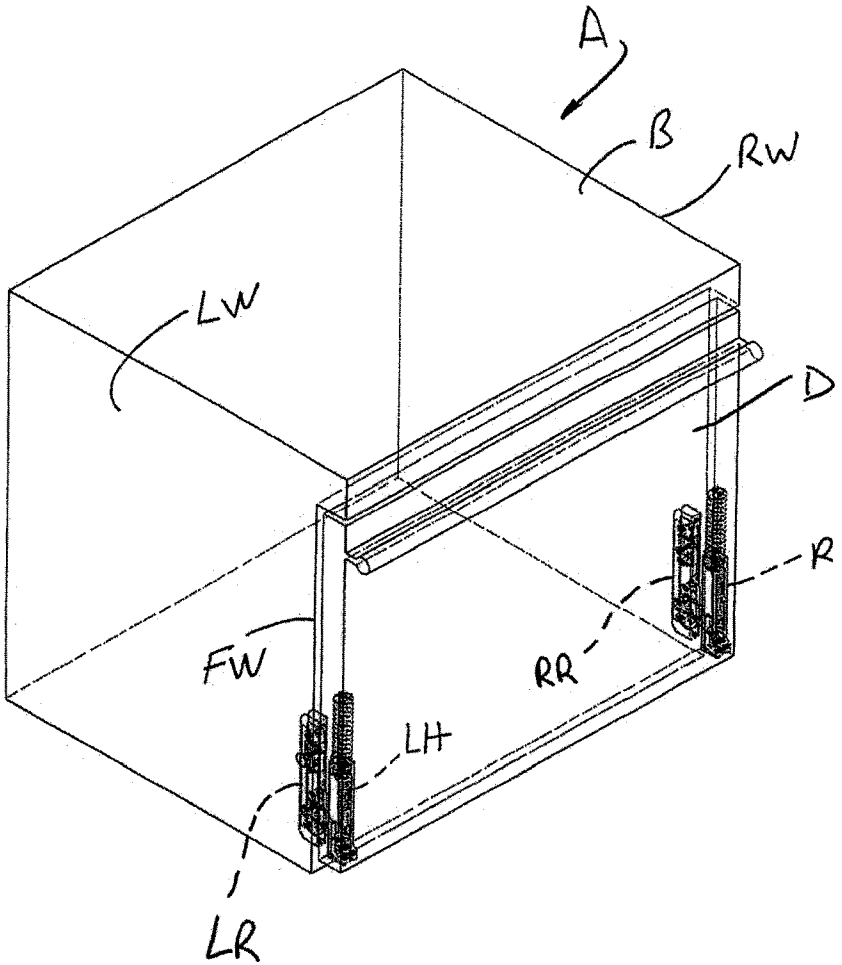

FIGS. 1A & 1B are left and right isometric views of an appliance A including a body B and a door D. The illustrated appliance A is a cooking oven, but the present invention is applicable to any other appliance such as a clothes washer, clothes dryer, freezer/refrigerator, dishwasher, etc. FIGS. 2A & 2B correspond respectively to FIGS. 1A & 1B but also use broken lines to show left and right hinge assemblies LH,RH connected to the door D and that are respectively mated with left and right adjustable hinge receivers LR,RR connected to the body B.

The door D pivots relative to the body B about a horizontal pivot axis X (FIG. 2B) between a closed position (shown), where the door D covers an internal hollow chamber C (such as a cooking chamber) defined in/by the body B, and an opened position, where the door D is pivoted outwardly away from a front wall FW of the body B to provide or allow access to the chamber C provided in the body B. An access opening to the chamber C is defined in the front wall FW of the appliance body B such that the chamber C opens through the front wall FW. In its closed position, the door D is located adjacent the front wall FW of the body B and covers and blocks the access opening of the chamber C.

The appliance body B also includes left and right side walls LW,RW located on the left and right lateral sides of the body B, respectively. The left and right hinge assemblies LH,RH are connected respectively to left and right lateral sides of the door D and mate respectively with left and right adjustable hinge receivers LR,RR that are each adjustable receivers formed in accordance with the present development as described herein (although the illustrated embodiment includes both left and right adjustable hinge receivers LR,RR provided in accordance with the present development, only one adjustable receiver constructed in accordance with the present development needs to be included, and the other receiver can be a standard non-adjustable or adjustable receiver). The left and right hinge receivers LR,RR are connected to the body B and are respectively located adjacent the left and right side walls LW,RW and respectively adjacent the opposite left and right lateral sides of the chamber C.

When the door D is in the closed position as shown, the left and right hinge receivers LR,RR are covered by the door D. In contrast to known adjustable receivers, however, the adjustable receivers LR,RR provided according to the present invention are accessible and operable to adjust the vertical position of the door D (for a door D that pivots about a horizontal pivot axis X) when the door D is in its closed position (or when the door is in an opened position) through access openings AO (FIGS. 1A & 1B) defined in or otherwise provided through the left and right side walls LW,RW. The access openings AO can be an aperture, slot, notch or any other void or open region that permits access to the adjustable receiver LR,RR to operate same as described below when the door D is in the closed position (or also when the door D is in the opened position).

The left and right hinge assemblies LH,RH are conventional and can be provided in any of a variety of well-known designs that are adapted to mate the left and right adjustable receivers LR,RR, respectively. As described below, the adjustable receivers LR,RR can be modified slightly in different embodiments so as to be configured to mate with different styles of known hinge assemblies LH,RH. Also, the left and right adjustable receivers are described below with primary reference to the right adjustable receiver RR. The left adjustable receiver LR can have the identical structure as the right adjustable receiver RR provided that the lead screw 34 (described below) is oriented in an opposite direction for input of torque thereto via opening AO as required to rotate the lead screw 34 to adjust the receiver LR. Alternatively, the left adjustable receiver LR can be provided as a mirror image of the right adjustable receiver RR or is otherwise correspondingly structured.

Figure 3A:
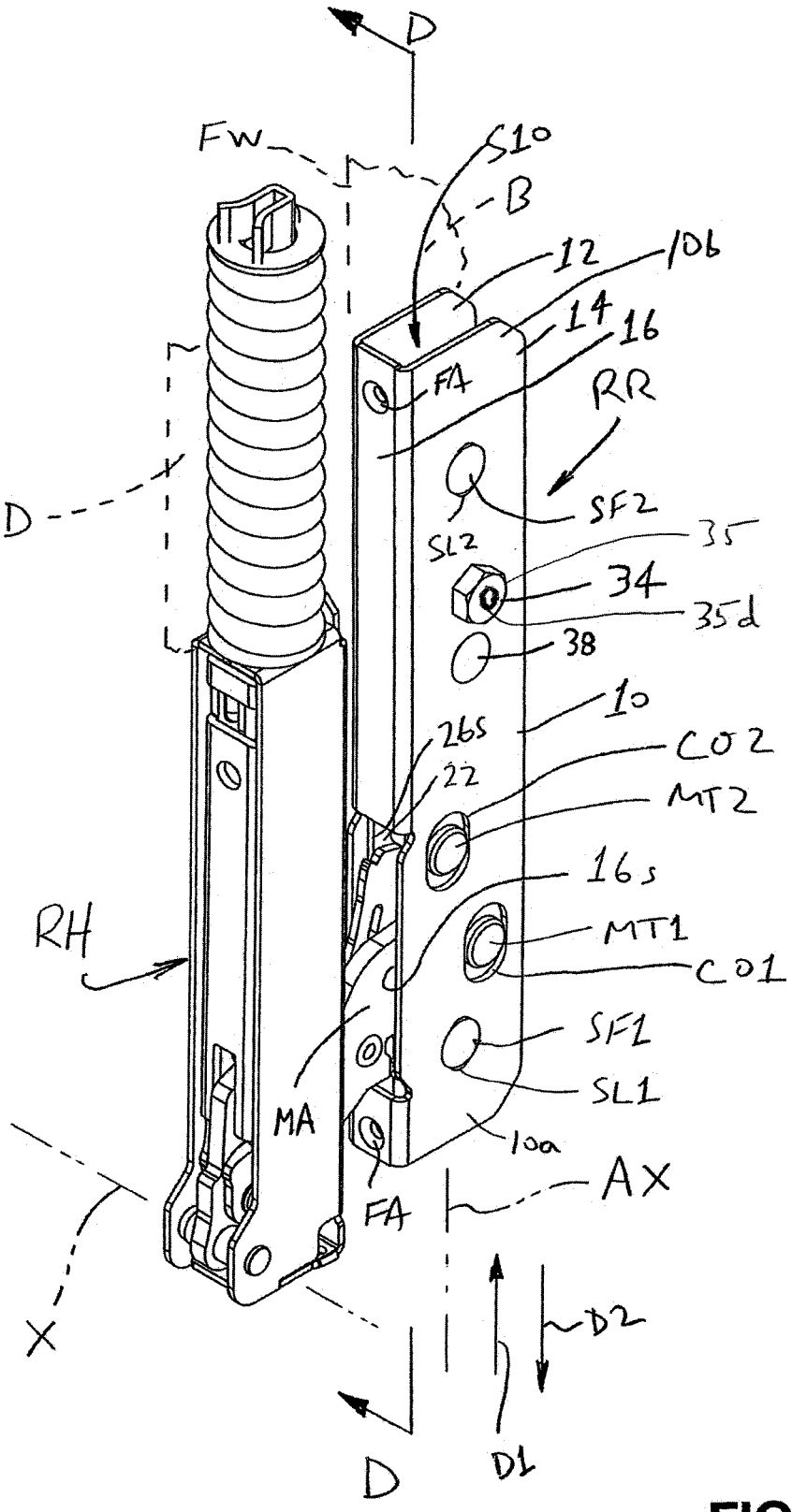
FIGS. 3A and 3B are respective right side and left side isometric views of a right adjustable hinge receiver formed in accordance with a first embodiment of the present development including a conventional right hinge assembly operative connected thereto.
Figure 3B:
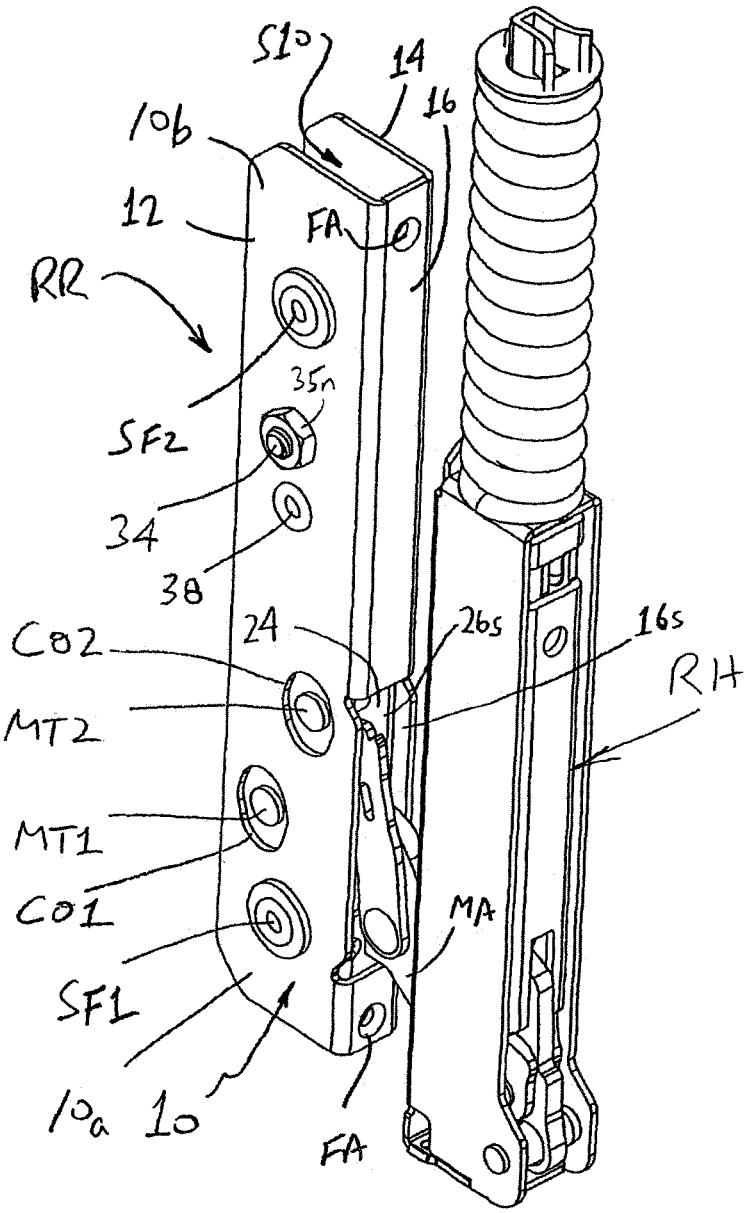
Figure 3C:
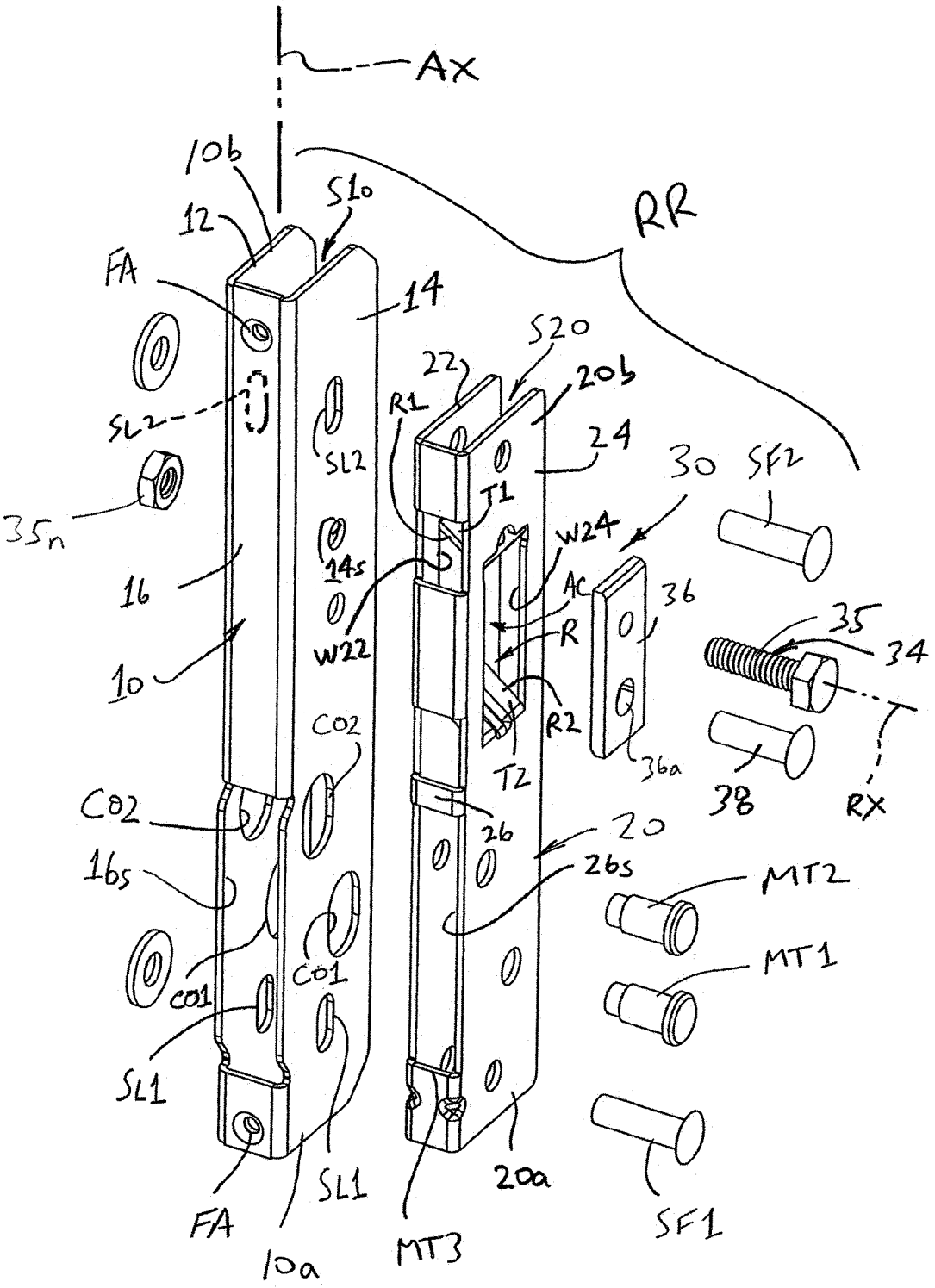
FIG. 3C is an exploded isometric view of the right adjustable receiver.
Figure 3D:
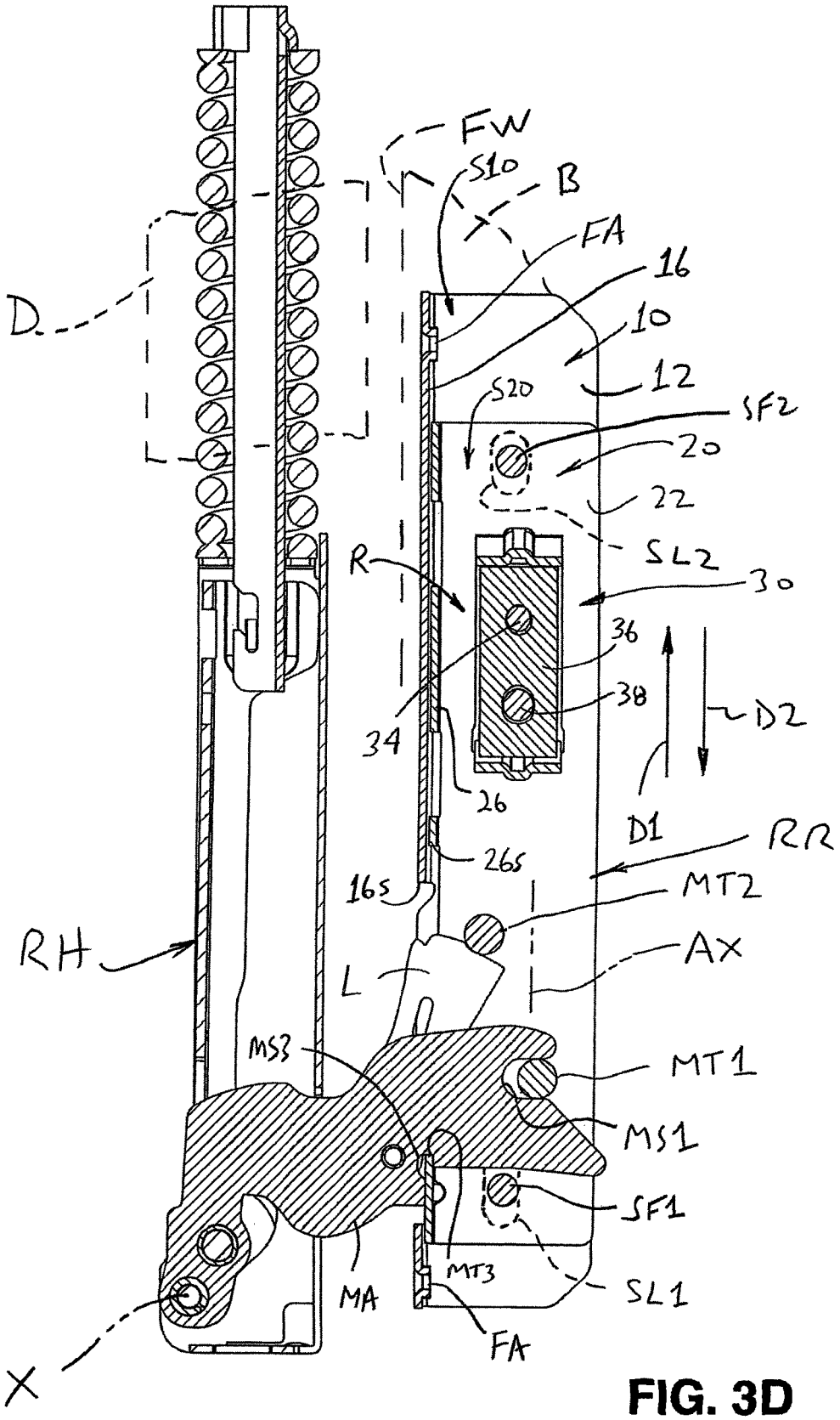
FIG. 3D is a section view of the right adjustable receiver taken at D-D of FIG. 3A.

FIGS. 3A and 3B are respective right side and left side isometric views of a right adjustable hinge receiver RR formed in accordance with a first embodiment of the present development including a conventional right hinge assembly RH operative connected thereto. The left adjustable hinge receiver LR is correspondingly structured to the right adjustable receiver RR and is typically provided with an identical structure except for the orientation of the adjustment system as described in more detail below (the left adjustable receiver can alternatively be provided as a mirror-image structure). FIG. 3C is an exploded isometric view of the right adjustable receiver RR. FIG. 3D is a section view of the right adjustable receiver RR taken at D-D of FIG. 3A.

It can be seen in FIGS. 3A-3D that the right hinge receiver RR comprises a base 10 that is adapted to be connected to the appliance body B adjacent the front wall FW in a fixed position via fasteners (not shown) installed in apertures FA provided in a front wall 16 of the base. The base 10 also comprises first and second parallel, spaced-apart base side walls 12,14 (also respectively referred to herein as first and second lateral walls 12,14) connected to each other by the front wall 16 such that the base 10 comprises or defined an open space S10 located between the lateral walls 12,14 and front wall 16. The base 10 thus defines a U-shaped cross-section.

The front wall 16 includes an access opening 16*s* such as a slot, notch, aperture, or other void that opens therethrough and into the space S10. The front wall access opening 16*s* is adapted to receive a mounting arm MA of the hinge assembly RH such that the mounting arm MA extends into the space S10 between the side/lateral walls 12,14 as required for the hinge assembly RH to be operably connected to mounting structures of the adjustable receiver RR as described further below. In one embodiment, the base 10 comprise a one-piece metal structure such as a stamped steel structure, but other metallic and/or non-metallic (e.g., polymeric) materials and other forming methods can be used to construct the base 10.

As best seen in the exploded view of FIG. 3C and the section view of FIG. 3D, the right adjustable receiver RR further comprises an inner slide body or slide member 20 connected to the base 10 and reciprocally linearly moveable or slidable relative to the base 10 in first and second opposite directions D1,D2 along an adjustment axis AX that extends parallel to the front wall 16 of the base 10 (the adjustment axis AX is vertically oriented when the door D is vertically oriented in its closed position for an oven or the like as shown in FIGS. 1A & 1B). The inner slide member 20 is located or nested in the space S10 and closely received between the first and second side/lateral walls 12,14 of the base 10, preferably with minimal clearance to minimize any lateral movement of the slide member 20 toward and away from the lateral walls 12,14.

In the illustrated embodiment, the inner slide member 20 comprises first and second parallel, spaced-apart side walls 22,24 connected to each other by a front wall 26 such that the inner slide member 20 comprises an open space S20 located between the side walls 22,24 and front wall 26. The inner slide member 20 thus defines a U-shaped cross-section. The front wall 26 of the inner slide member 20 is abutted with or otherwise arranged adjacent the front wall 16 of the base 10 and includes an opening 26*s* defined therein such as a slot, notch, aperture, or other void that opens therethrough and into the space S20. When the inner slide member 20 is operatively connected to the base 10 and nested in the space S10 between the base lateral walls 12,14, the opening 26*s* in the front wall 26 of the inner slide member 20 is at least partially aligned or registered with the opening 16*s* in the front wall 16 of the base 10, and the first side wall, second side wall, and front wall 22, 24, 26 of the inner slide member 20 lie respectively adjacent and slidably abut the first lateral wall, second lateral wall, and front wall 12, 14, 16 of the base 10. In one embodiment, the inner slide member 20 comprise a one-piece metal structure such as a stamped steel structure, but other metallic and/or non-metallic (e.g., polymeric) materials and other forming methods can be used to construct the inner slide member 20.

As noted above and as shown in FIGS. 3C & 3D, the right hinge assembly RH includes a mounting arm MA that is adapted to be engaged or mated with the right adjustable receiver RR (or the left adjustable receiver LR). Accordingly, the inner slide member 20 includes at least one hinge mounting structure MT connected thereto and/or formed as a part thereof for being engaged by and mated with the mounting arm MA of the hinge assembly RH. In the illustrated embodiment, the at least one mounting structure MT is provided by first and second mounting pins or mounting studs MT1,MT2 that extend between and are engaged with the opposite first and second side walls 22,24 of the inner slide member such that the first and second mounting studs MT1,MT2 extend through the space S20 defined between the side walls 22,24 of the inner slide member 20. The first and second mounting studs MT1,MT2 are spaced-apart from each other with respect to the adjustment axis AX but are not necessarily aligned with each other along the adjustment axis AX or any other particular axis. The one or more mounting studs MT1,MT2 each extend through the space S20 between the side walls 22,24 along respective mount axes MX1,MX2 (see FIGS. 4A-4C). In the illustrated embodiment, the first and second mounting studs MT1,MT2 comprise respective shoulder rivets or similar fasteners, but other structures can be used. As shown in the present embodiment, the at least one mounting structure MT further comprises a third mounting structure MT3 provided by a portion of the inner slide member 20, itself. As shown herein, the third mounting structure MT3 comprises a portion of the front wall 26, in particular, a lower edge of the opening 26*s* defined in the front wall 26. The mounting arm MA of the hinge assembly RH includes slots, recess, grooves, edges, and/or other structures for engaging and/or mating the respective first, second, and third mounting structures MT1,MT2,MT3 of the adjustable receiver RR.

In the illustrated embodiment, the mounting arm MA of the hinge assembly RH includes an optional pivoting latch L that is selectively manually pivotable into the illustrated operative position to engage the second mounting structure MT2 to operatively capture the mounting arm MA to the adjustable receiver after the first and third mounting structures MT1,MT3 are engaged by respective slots MS1,MS3 of the mounting arm MA. The latch L thus prevents inadvertent separation of the mounting arm MA (and hinge assembly RH) from the adjustable receiver RR by preventing the slots MS1,MS3 from being disengaged from the respective mounting structures MT1,MT3 of the adjustable receiver RR. It should be noted that the base 10 includes a first (lower) end 10*a* and an opposite second (upper) end 10*b*, wherein the mounting structures MT are located closer to the first end 10*a* of the base 10 as compared to the second end 10*b* of the base 10. The latch L is optional and can be omitted such as on hinges where there is no reversal of force that would tend to dislodge the mounting arm MA from the slide member 20. Alternatively, a screw, fastener, clip, and/or other secondary attachment device can be used to directly or indirectly connect the mounting arm MA to the slide member 20.

Figure 3E:
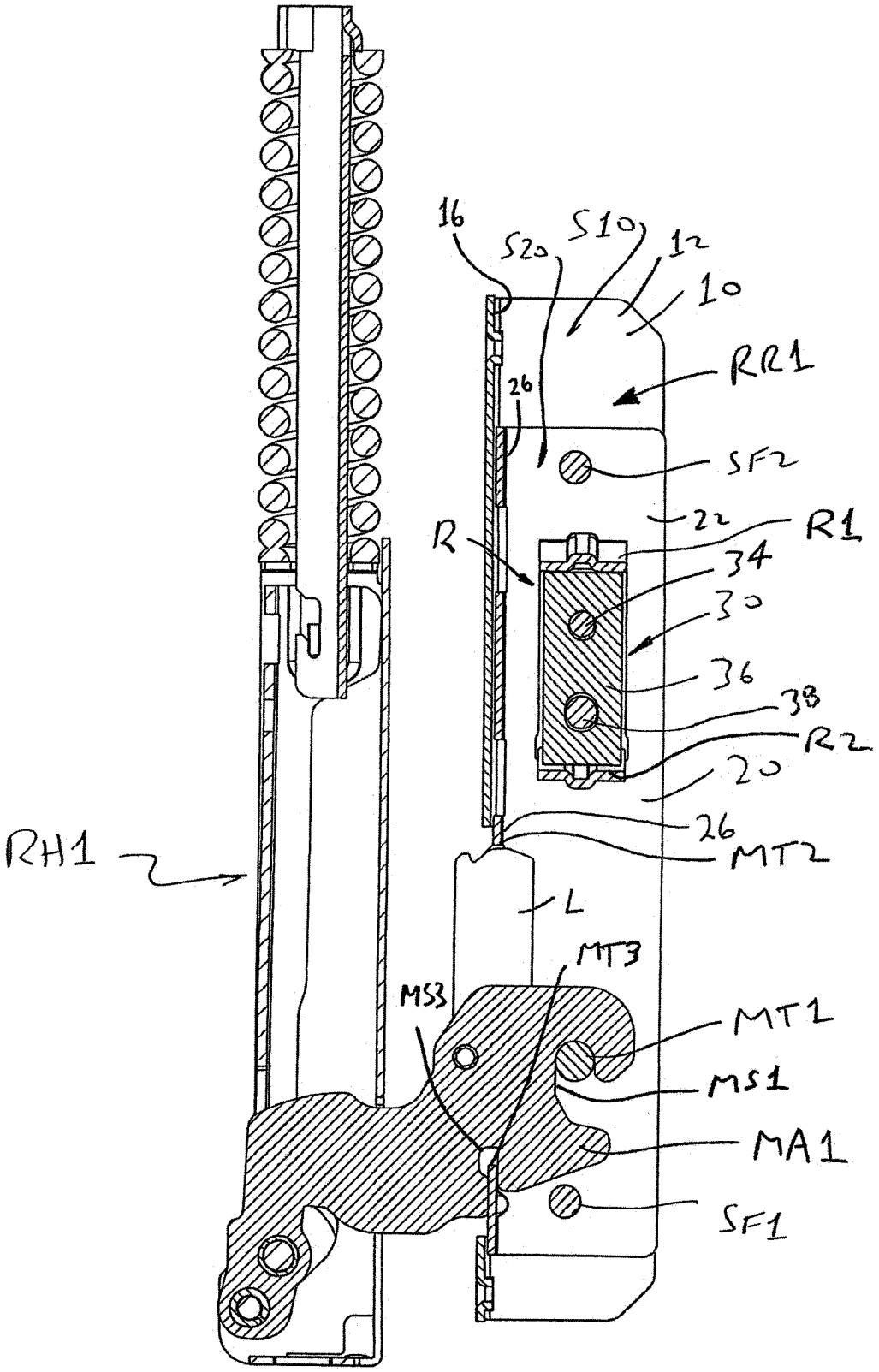
FIGS. 3E & 3F are each similar to FIG. 3D but show respective alternative embodiments of the right adjustable receiver that are each similar to the right adjustable receiver of FIGS. 3A-3D but are respectively configured to mate with a different hinge mounting arms of alternative hinge assemblies.
Figure 3F:
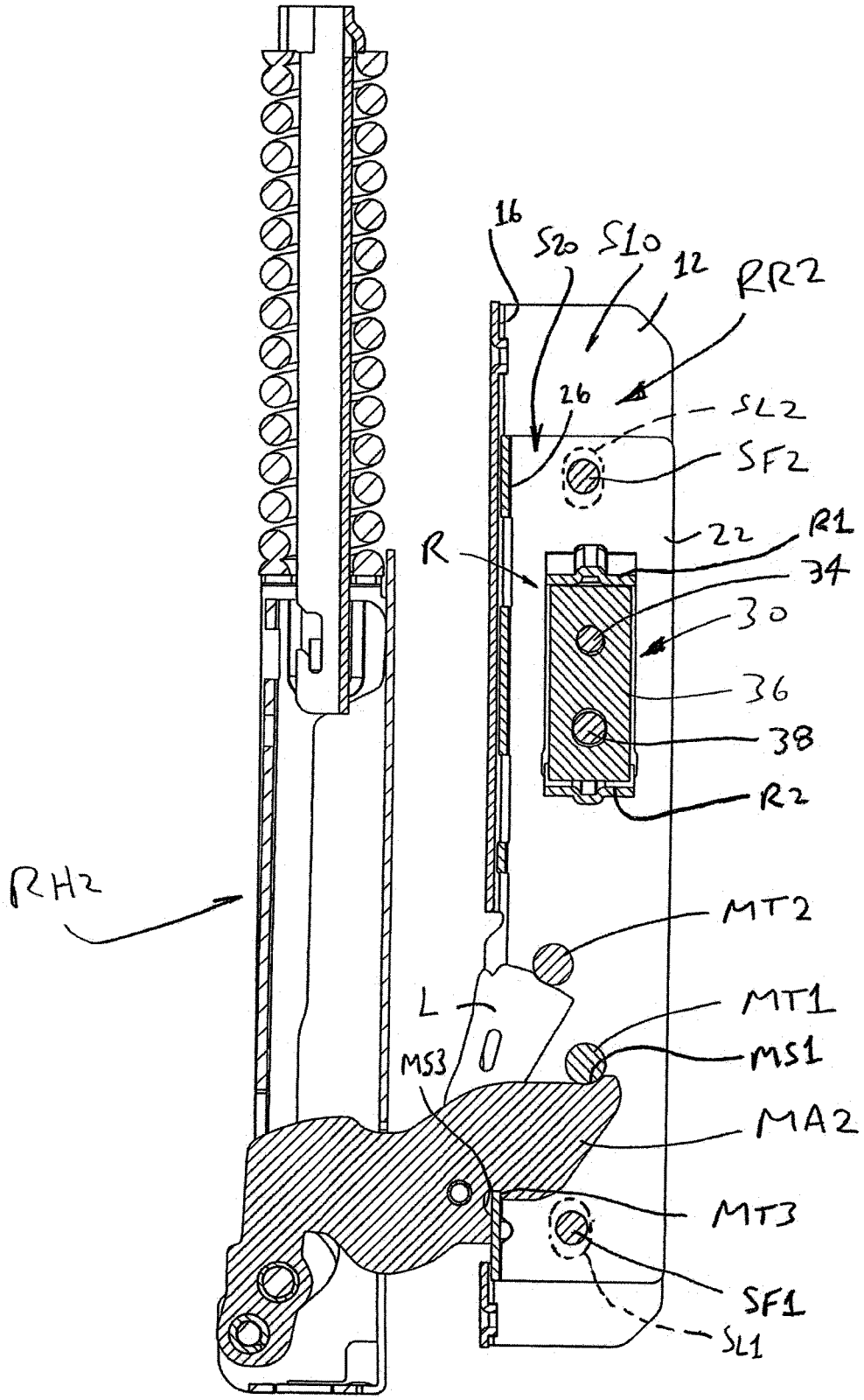

FIGS. 3E & 3F are each similar to FIG. 3D but show respective alternative embodiments RR1 and RR2 of the right adjustable receiver that are each similar to the right adjustable receiver of FIGS. 3A-3D but are respectively configured to mate with a different hinge mounting arms MA1,MM2 of alternative hinge assemblies RH1,RH2. The adjustable receiver RR1 of FIG. 3E differs from the adjustable receiver RR in that the second mounting structure MT2 is provided by a portion of the wall 26 of the inner slide member 20 instead of a stud connected to the inner slide member 20. More particularly, as shown in FIG. 3E, the second mounting structure MT2 is provided by an upper edge of the opening 26*s* defined in the front wall 26, and the adjustable receiver RR1 is thus configured to mate with the alternative mounting arm MA1 of the hinge assembly RH1. The adjustable receiver RR2 of FIG. 3F is similar to the adjustable receiver RR of FIGS. 3A-3D, but the respective locations of the studs that provide the first and second mounting structures MT1,MT2 are different relative to each other and as compared to the adjustable receiver RR so that the adjustable receiver RR2 is configured and adapted to mate with an alternative hinge mounting arm MA2 of the hinge assembly RH2.

Referring again to FIGS. 3A-3D, the inner slide member 20 located in the space S10 of the base 10 is slidably connected to the base 10 by first and second slide fasteners SF1,SF2. The first and second lateral walls 12,14 of the base 10 each include a lower (first) elongated slot SL1 and an upper (second) elongated slot SL2. The lower elongated slots SL1 of the first and second lateral walls 12,14 are aligned with each other across the space S10, and the upper elongated slots SL2 of the first and second lateral walls 12,14 are aligned with each other across the space S10 (the slots SL1,SL2 of the lateral side wall 12 are shown in broken lines in FIG. 3D since they are hidden behind the slide member 20). The first and second elongated slots SL1,SL2 of each lateral wall 12,14 are spaced apart from each other along the adjustment axis AX and are each elongated along the adjustment axis AX. The opposite ends of the first (lower) slide fastener SF1 are located respectively in the aligned lower elongated slots SL1 of the first and second lateral walls 12,14 such that the first slide fastener SF1 extends through the space S10 defined between the lateral walls 12,14 of the base 10 and is movable along the adjustment axis AX in the aligned pair of lower elongated slots SL1. Likewise, the opposite ends of the second (upper) slide fastener SF2 are located respectively in the upper elongated slots SL2 of the aligned first and second lateral walls 12,14 such that the second slide fastener SF2 extends through the space S10 defined between the lateral walls 12,14 of the base 10 and is movable along the adjustment axis AX in the aligned pair of upper elongated slots SL2. Both of the first and second slide fasteners SF1,SF2 also extend through and are engaged with the side walls 22,24 of the inner slide member 20, and the slide fasteners SF1,SF2 also extend though the space S20 between the side walls 22,24, and are thus engaged with the inner slide member 20 such that movement of the inner slide member 20 along the adjustment axis AX in first and second opposite directions D1,D2 results in corresponding movement of the first and second slide fasteners SF1,SF2 in the respective elongated slots SL1,SL2 in the first and second directions D1,D2. As such, engagement of the first slide fastener SF1 in the aligned lower pair of elongated slots SL1 and engagement of the second slide fastener SF2 in the aligned upper pair of elongated slots SL2 controls, limits, and defines the path of the reciprocal sliding movement of the inner slide member 20 relative to the base 10 along the adjustment axis AX in the first and second directions D1,D2. It should be noted again that the hinge mounting structures MT (MT1,MT2, MT3) are connected to and/or formed as part of the inner slide member 20. Thus, the hinge mounting structures MT (MT1,MT2,MT3) and a hinge assembly RH engaged therewith move with the inner slide member 20 in the first and second directions D1,D2 when the inner slide member 20 moves relative to the base 10 in the first and second directions D1,D2, i.e., when the position of the inner slide member 20 relative to the base 10 is changed, the position of the hinge mounting structures MT relative to the base 10 also correspondingly changes, along with any hinge assembly RH connected to the hinge mounting structures MT.

In the illustrated embodiment, the lateral walls 12,14 of the base 10 each include first (lower) and second (upper) clearance openings CO1,CO2 that allow for installation of the first and second mounting structures MT1,MT2 after the inner slide member 20 is installed in the space S10 between the lateral walls 12,14 of the base 10. The first and second clearance openings CO1,CO2 are each elongated at least along the adjustment axis AX or otherwise enlarged to allow for movement of the projecting ends of the first and second mounting structures MT1,MT2 during movement of the inner slide member 20 relative to the base 10 in the first and second directions D1,D2. In the embodiment shown herein, the clearance openings CO1,CO2 are conformed and dimensioned to limit movement of the first and second mounting structures MT1,MT2 therein in any direction except along the adjustment axis AX to further control and limit the path of movement of the inner slide member 20 relative to the base 10 and to further strengthen the assembly of the inner slide member 20 to the base 10 to resist any forces that might tend to urge the inner slide member 20 away from the front wall 16 of the base 10.

Figure 4A:
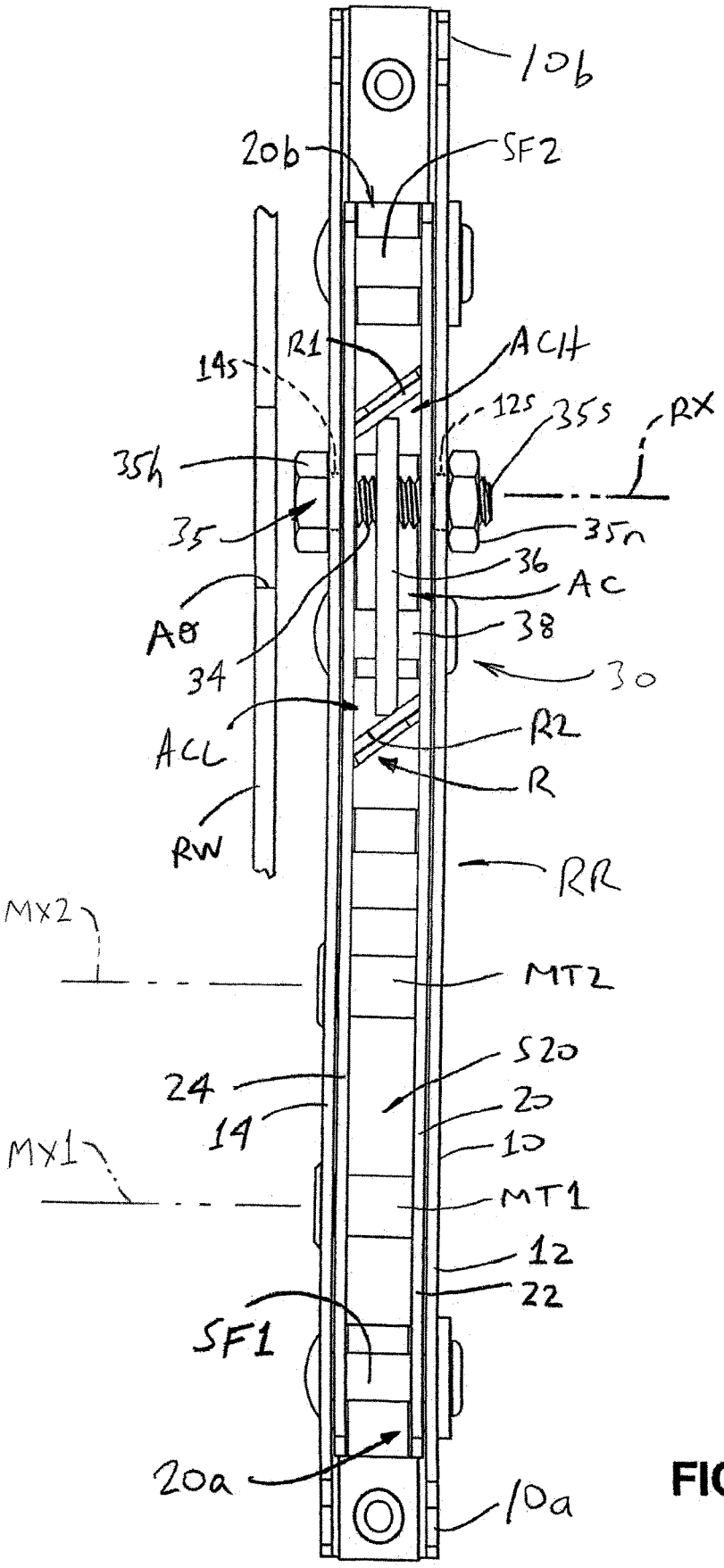
FIGS. 4A, 4B, and 4C are rear views of the right adjustable receiver that respectively show the adjustable receiver in a neutral (or "mid") position, a first (or "down") position, and a second (or "up")
Figure 4B:
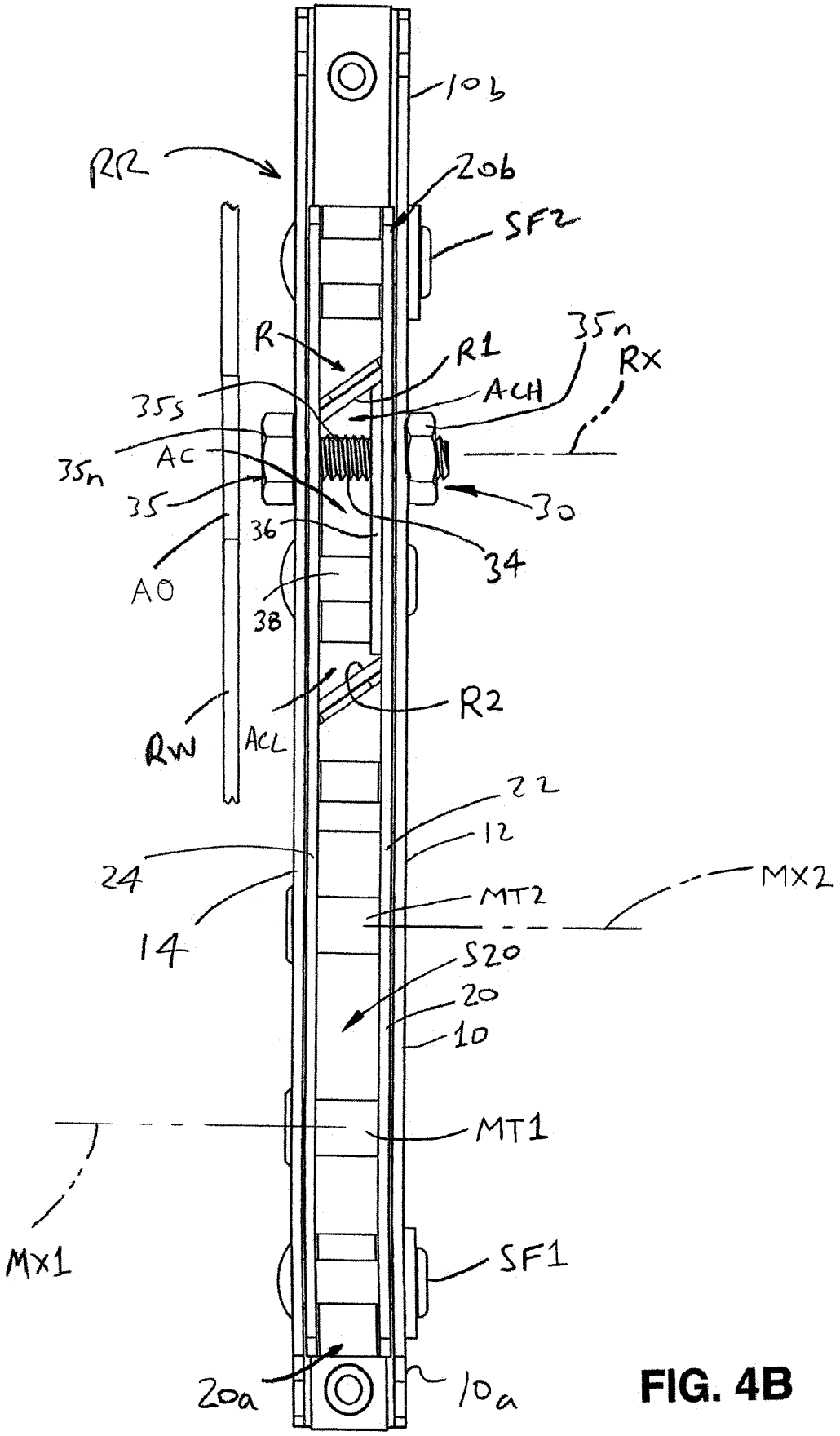
Figure 4C:
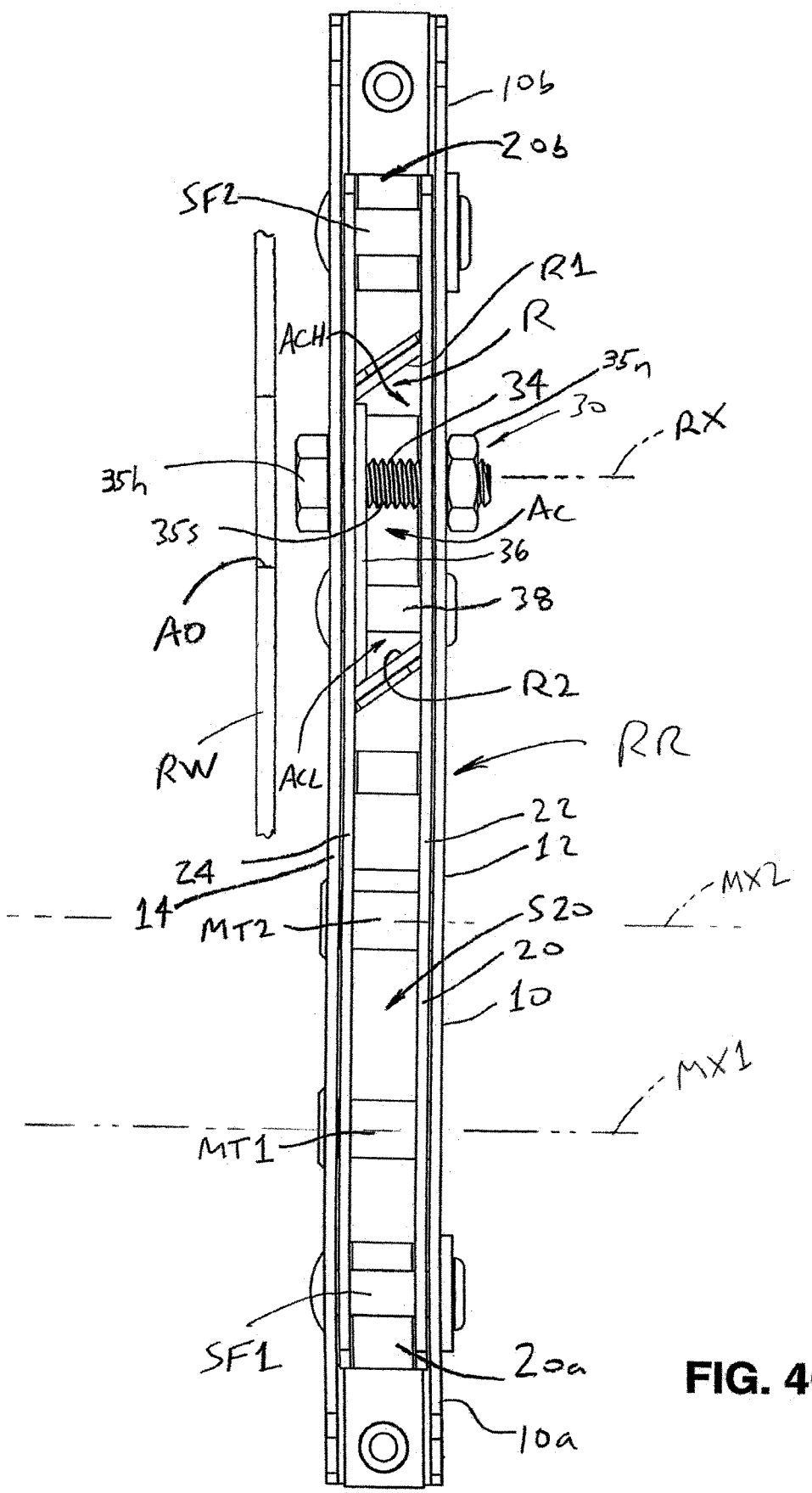

With reference also to the rear views of FIGS. 4A, 4B, and 4C, the right adjustable receiver RR (and the left adjustable receiver LR) includes an adjustment system 30 by which a user manually controls and sets the axial position of the inner slide member 20 relative to the base 10 along the adjustment axis AX. More particularly, the slide member 20 includes or is operably engaged with a ramp structure R that forms part of the adjustment system 30. The ramp structure R is connected to and/or formed as a part of the slide member 20. The ramp structure R includes first (upper) and second (lower) ramps R1,R2 that are each inclined relative to the first and second side walls 22,24 of the slide member 20 so that the first and second ramps R1,R2 are each not oriented perpendicularly with respect to the first and second side walls 22,24. The first and second inclined ramps R1,R2 are arranged to be spaced-apart and parallel with respect to each other such that an open, inclined adjustment channel AC is defined between the first and second ramps R1,R2. In the illustrated embodiment, the first ramp R1 is defined by a first tab portion T1 (FIG. 3C) of the first side wall 22 of the slide member 20 that is deflected into the space S20 toward or into contact with the second side wall 24, and the second ramp R2 is defined by a second tab portion T2 (FIG. 3C) of the second side wall 24 of the slide member 20 that is deflected into the space S20 toward or into contact with the first side wall 22. The access openings W22,W24 located respectively in the side walls 22,24 result from the void defined or created when the tab portions T1,T2 are deflected inwardly to provide the first and second ramps R1,R2.

The inclined adjustment channel AC defined between the first and second ramps R1,R2 includes a first or low side or low end ACL and a second or high side or high end ACH. The first/low end ACL of the adjustment channel AC is located closer to the hinge mounting structures MT (MT1, MT2,MT3) (i.e., located closer to the first end 20*a* of the slide member 20) because it is defined between the respective first or low ends of the ramps R1,R2 that are located closer to the hinge mounting structures MT (MT1,MT2, MT3) (i.e., located closer to the first end 20*a* of the slide member 20) as compared to their respective opposite ends. Correspondingly, the second/high end ACH of the adjustment channel AC is located closer to the second slide fastener SF2 (i.e., closer to the opposite, second end 20*b* of the slide member 20 that is spaced from the first end 20*a* of the slide member 20 and spaced from the hinge mounting structures MT) because it is defined between the respective second or high ends of the ramps R1,R2 that are located farther away from the hinge mounting structures MT (MT1, MT2,MT3) (i.e., located closer to the second end 20*b* of the slide member 20) as compared to the opposite ends of the ramps R1,R2. An adjustment member 36 or at least a part thereof is closely received in the adjustment channel AC between and operably engaged with the first and second ramps R1,R2 and its position relative to the first (low) and second (high) ends ACL,ACH of the adjustment channel AC, as controlled by the adjustment system 30, determines the axial location of the inner slide member 20 relative to the base 10 along the adjustment axis AX.

With continuing reference to FIGS. 4A-4C, FIG. 4A shows the inner slide member 20 in a neutral or mid position based upon the adjustment member 36 being located in a neutral or mid position halfway between the side walls 22,24 of the inner slide member 20 and halfway between the low and high ends ACL,ACH of the adjustment channel AC. FIG. 4B shows the inner slide member 20 in a first or "down" position based upon the adjustment member 36 being located in a first position adjacent the first side wall 22 of the slide member 20 where the adjustment member 36 is located at the high end ACH of the adjustment channel AC closer to the high side of both the first and second ramps R1,R2. FIG. 4C shows the inner slide member 20 in a second or "up" position based upon the adjustment member 36 being located in a second position adjacent the second side wall 24 of the slide member 20 where the adjustment member 36 is located in the low end ACL of the adjustment channel AC closer to the low side of both the first and second ramps R1,R2.

In the illustrated embodiment, the adjustment system 30 further comprises a cam adjustment system comprising a rotatable adjustment shaft or adjustment screw such as lead screw 34 and the adjustment member 36 that is threadably engaged with the adjustment screw/lead screw 34. More particularly, in the illustrated embodiment, the lead screw 34 comprises a helically threaded shaft that extends along an axis of rotation RX through the lateral walls 12,14 of the base 10 and through the space S10 between the first and second lateral walls 12,14 of the base 10. Alternatively, the lead screw or other adjustment shaft comprises a cam profile or other projection(s) that extend around the axis of rotation RX. The lead screw 34 also extends along the axis of rotation RX through the side walls 22,24 of the slide member 20 and through the space S20 of the slide member 20. The lead screw 34 is rotatably supported by (but not threadably engaged with) the first and second lateral walls 12,14 of the base 10. The lead screw 34 extends through enlarged first and second slots, notches, or openings W22, W24 (FIG. 3C) respectively defined in the first and second side walls 22,24 of the slide member 20 so that the lead screw 34 does not interfere with the linear sliding movement of the slide member 20 in the first and second directions D1,D2 and so that the lead screw 34 is not threadably engaged with the first and second side walls 22,24 of the slide member 20. As such, the lead screw 34 is rotatable in first (counter-clockwise) and second (clockwise) directions relative to the base 10 and slide member 20 about its axis of rotation RX without inducing any axial movement of the lead screw 34 along the axis of rotation RX relative to the base 10 and slide member 20.

The lead screw 34 extends along and is rotatable about the axis of rotation RX. In the illustrated embodiment, the lead screw 34 comprises a bolt 35 including a threaded shank 35*s*, a driving head 35*h*, and a nut 35*n* threaded or otherwise secured on the shank 35*s*. The head 35*h* defines a hexagonal or other non-circular shape suitable for rotating the bolt about its axis of rotation RX by a wrench or other tool engaged with the head 35*h*. The head 35 can alternatively or additionally include a slot, recess, or other internal drive structure such as a Torx, hexagonal (hex), Phillips, slot, and/or other internal drive structure 35*d* (FIG. 3A). When the receiver RR is operatively installed on the appliance body B, the head 35*h* is aligned with the access opening AO defined in the right side wall RW (or left side wall LW for the left adjustable receiver LR) to provide access to the head 35*h* for rotating same. The shank 35*s* is operatively inserted through (but not threadably engaged with) respective first and second lead screw apertures 12*s*,14*s* (see FIG. 4A) defined respectively in the first and second side walls 12,14 of the base 10, and the nut 35*n* is installed on the shank 35*s* to capture the bolt in its operative position (the hut 35*n* can be replaced with a cap, pin, or other structure to prevent withdrawal of the bolt 35 once it is operatively installed on the base 10. After the nut 35*n* is installed on the shank 35*s*, the shank 35*s* and/or nut 35*n* are configured or arranged such that the nut 35*n* cannot be threadably back-driven or otherwise removed from the shank 35*s* under normal operative conditions when the bolt 35 is rotated in clockwise or counter-clockwise directions. In particular, the threads of the shank 35*s* are peened or otherwise deformed or blocked, or the nut 35*n* is adhered or welded or otherwise non-rotatably secured to the shank 35*s*. The nut 35*n* can be replaced by a washer, push-nut, pin, or any other suitable retainer that is secured to the shank 35*s* to prevent the bolt from being withdrawn from the lead screw apertures 12*s*,14*s* of the base 10. In one embodiment, the nut 35*n*, which defines a hexagonal or other non-circular shape suitable for being rotated by a wrench or other tool, is non-rotatably secured to the shank 35*s* by welding, adhesive, upsetting threads, use of a castellated or "castle" nut and pin, or otherwise mechanically, non-rotatably interlocked with the shank 35*s*, such that the lead screw 34 can be rotated about its axis of rotation RX by rotatably driving either the head 35*h* or the nut 35*n* which makes the bolt 35 universal in the sense that it can be installed with either its head 35*h* or nut 35*n* adjacent the first lateral wall 12 of the base 10 and either the head 35*h* or nut 35*n* can be driven to operably rotate the lead screw 34 about its axis of rotation RX in the desired clockwise or counter-clockwise direction (which allows the right receiver RR to be used as a left receiver LR without any modifications since either the head 35*h* or nut 35*n* can be rotated to operate the adjustment system 30).

The adjustment member 36 is threadably engaged with the lead screw 34 (with the threaded shank 35*s* of the bolt 35 in the illustrated embodiment) and located in the space S20 between the side walls 22,24 of the inner slide member 20 in the adjustment channel AC adjacent the first and second ramps R1,R2 such that rotation of the lead screw 34 in a first (counter-clockwise) direction about its axis of rotation RX relative to the adjustment member 36 causes axial linear translation of the adjustment member 36 in the adjustment channel AC along the axis of rotation RX of the lead screw 34 in a first direction toward the first side wall 22 of the slide member 20 (toward the high end ACH of the adjustment channel AC in the illustrated embodiment) and such that rotation of the lead screw 34 in a second (clockwise) direction that is opposite the first direction relative to the adjustment member 36 causes linear translation of the adjustment member 36 in the adjustment channel AC along the axis of rotation of the lead screw 34 in an opposite, second direction toward the second side wall 24 of the inner slide member 20 (toward the low end ACL of the adjustment channel AC in the illustrated embodiment). Movement of the adjustment member 36 toward the high end ACH of the adjustment channel AC (toward the first side wall 22 of the slide member 20) causes the adjustment member 36 to bear against the ramp R2 and urge the slide member 20 downward toward the first end 10*a* of the base 10. Movement of the adjustment member 36 in the opposite direction toward the low end ACL of the adjustment channel AC (toward the second side wall 24 of the slide member 24) causes the adjustment member 36 to bear against the upper ramp R1 and urge the slide member 20 upward toward the second end 10*b* of the base 10. Furthermore, the axis of rotation RX of the lead screw 34 is beneficially oriented parallel to the first and second mount axis MX1,MX2 to overcome some of the above-noted deficiencies of prior adjustable hinge receiver designs. In the case where the lead screw 34 comprises a cam profile rather than a helical thread, the adjustment member 36 is engaged with the cam profile according to a cam-follower relationship whereby rotation of the lead screw 34 about its axis of rotation RX in opposite first and second rotational directions (clockwise/counter-clockwise) induces axial movement of the adjustment member 36 along the axis of rotation RX in corresponding first and second axial directions, respectively. In general terms, as used herein the terms "adjustment screw," "adjustment shaft," or "lead screw" are each intended to encompass any rotational shaft that is mechanically engaged with the adjustment member 36 such that rotation of the shaft 34 about its axis of rotation RX in opposite first and second rotational directions induces axial movement of the adjustment member 36 along the axis of rotation RX in corresponding first and second axial directions, respectively.

The second, lower ramp R2 can optionally be omitted from the ramp structure R in which case the slide member 20 moves downward toward the first end 10*a* of the base 10 by force of gravity when the adjustment member 36 moves toward the first side wall 22 of the slide member 20, but it is desirable to include the second/lower ramp R2 so that the adjustment member 36 actively forces the slide member 20 downward when the adjustment system 30 is operated to move the adjustment member 36 in the first direction toward the first slide wall 22 of the slide member 20 rather than relying on gravity to move the slide member 20 downward, since a gravity operated system is more likely to stick or jamb due to the natural rotational torque applied to the slide member 20 from the weight of the door D, or if out of alignment or obstructed.

The lead screw 34 and adjustment member 36 can be either right-hand threaded (as shown) or left-hand threaded as desired to select the directions of rotation (clockwise or counter-clockwise) that induce the first and second directions of linear translation of the adjustment member 36 between the slide member side walls 22,24. FIGS. 4A-4D show a right-hand threaded lead screw 34 and adjustment member 36 such that counter-clockwise rotation of the lead screw 34 causes translation of the adjustment member 36 in the first direction toward the first side wall 22 of the slide member 20 and such that clockwise rotation of the lead screw 34 causes translation of the adjustment member 36 in the second direction toward the second side wall 24 of the slide member 20 (and the opposite would be true when a left-hand thread is used for lead screw 34).

The adjustment member 36 is shown herein as a rectangular plate structure but can alternatively be provided in any desired shape, size, and structure such as a nut, block, winged structure or other member that is threaded onto the lead screw 34. In addition to being threadably engaged with the lead screw 34, the adjustment member 36 slidably supported in the space S20 and prevented from rotating with the lead screw 34 relative to the slide member 20 and base 10 by a or support arm or support shaft 38 such as a rod, pin, or rail that extends through or that is otherwise slidably engaged with the adjustment member 36. The support arm/shaft 38 is arranged parallel to the axis of rotation RX and is arranged parallel to and spaced-apart from the lead screw 34. The adjustment member 36 is slidably supported on the support shaft 38 for movement on the support shaft toward and away from the side walls 22,24 of the slide member 20. As shown herein, the adjustment member 36 includes an aperture 36*a* (FIG. 3C) having an aperture diameter that is larger than a shaft diameter of the support shaft 38 and through which the support shaft 38 extends. The support shaft 38 is fixedly and immovably secured to the base 10 by being engaged with the first and second lateral side walls 12,14 of the base 10 such that the support shaft 38 extends through the space S10 of the base 10. The support shaft 38 is shown herein as being provided by a rivet that extends between and is connected to the first and second lateral walls 12,14 of the base 10, but it can alternatively be provided by another fastener, pin, or other fastener or other structure that has its opposite ends engaged with and fixedly secured to the lateral side walls 12,14 of the base 10 or that is otherwise connected to and/or formed as part of the base 10. It should be noted that the rivet or other support shaft 38 is not engaged with the side walls 22,24 of the slide member 20 in order not to obstruct or prevent the slide member 20 from moving relative to the base 10 in the first and second directions D1,D2 along the adjustment axis AX. As noted, the side walls 22,24 of the slide member 20 include enlarged first and second slots, notches, or openings W22,W24 (FIG. 3C) respectively defined therein and through which the support shaft 38 and lead screw 34 extend so that the support shaft 38 and lead screw 34 each extend through the adjustment channel AC between the first and second inclined ramps R1,R2 and do not interfere with the linear sliding movement of the slide member 20 in the first and second directions D1,D2 along the adjustment axis AX relative to the base 10, lead screw 34, and support shaft 38. Alternatively, the support shaft 38 can be omitted if another structure is provided to prevent rotation of the adjustment member 36 with the lead screw 34 when the lead screw 34 is rotated. In one such example, the slide member 20 comprises one or more projecting flaps or tabs or other structures (such as the optional tab 36*r* shown in FIG. 6) that contact the adjustment member 36 and prevent rotation of the adjustment member 36 when the lead screw 34 is rotated while still allowing the adjustment member 36 to move axially along the axis of rotation RX of the lead screw 34 when the lead screw 34 is rotated.

Figure 5A:
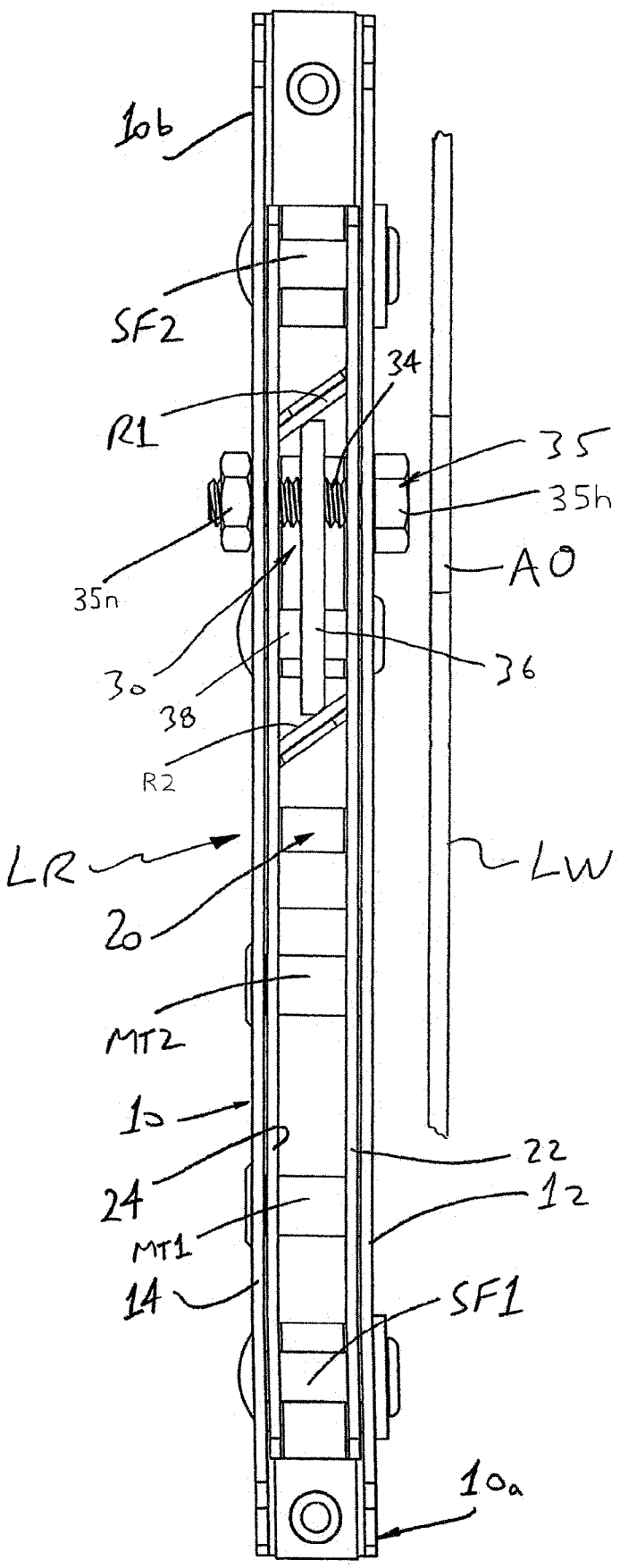
FIGS. 5A, 5B, and 5C that correspond respectively to FIGS. 4A, 4B, and 4C but show the lead screw installed in an opposite orientation to provide an embodiment of a left adjustable receiver.
Figure 5B:
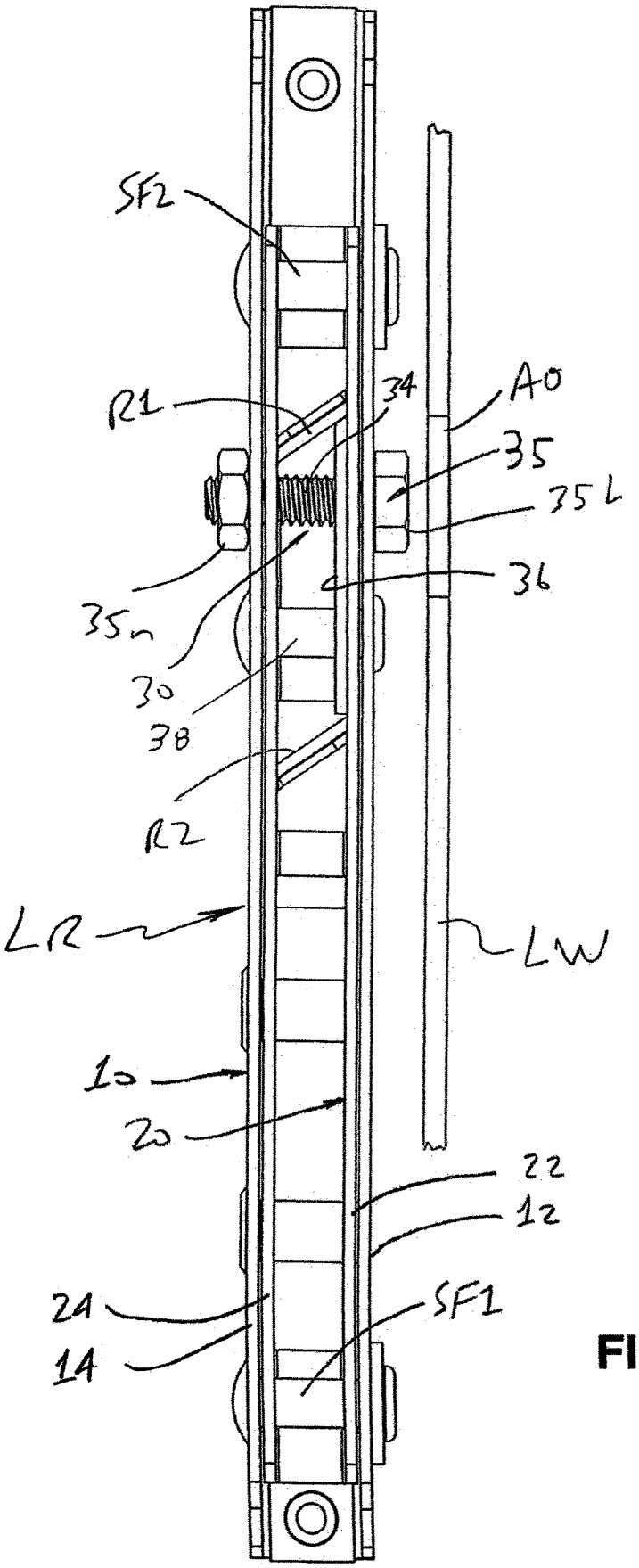
Figure 5C:
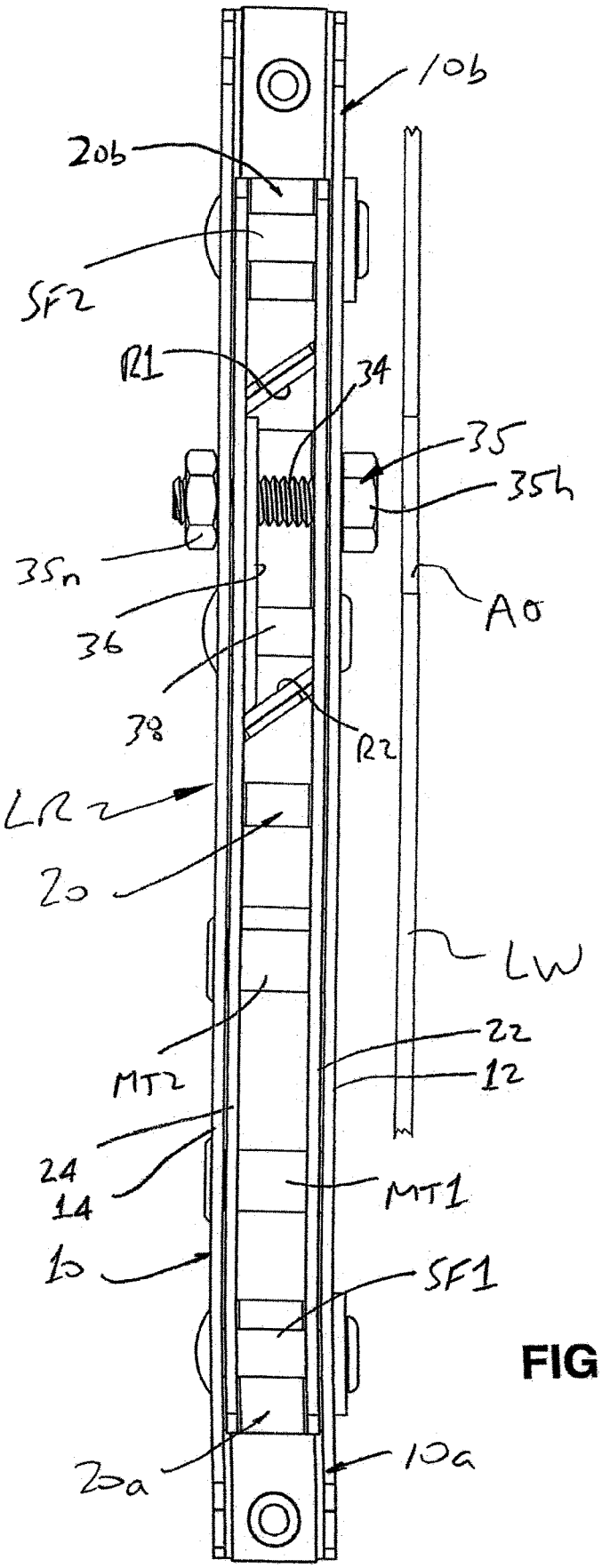
Figure 6:
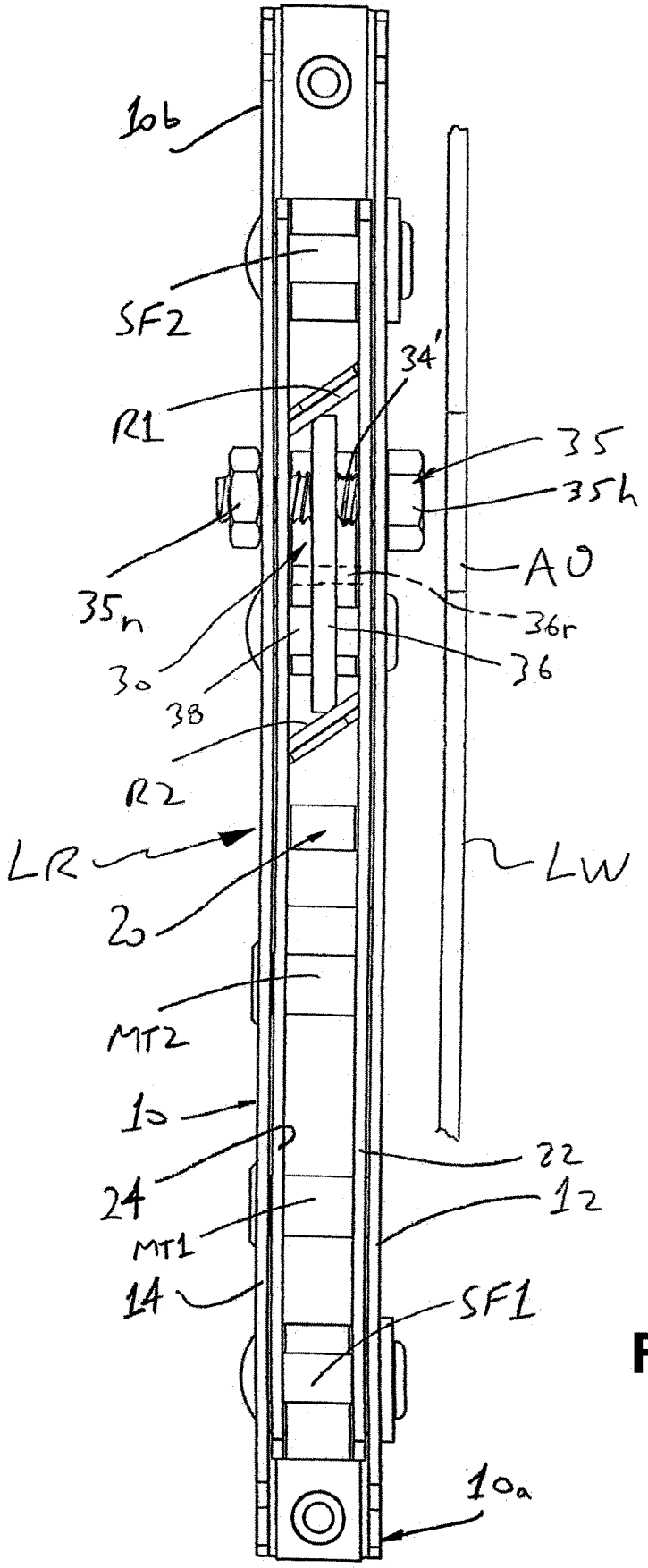
FIG. 6 is similar to FIG. 5A but shows an alternative lead screw formed with a left-hand thread.

The ramps R1,R2 can alternatively be inclined in the opposite direction to that shown herein, for example, to provide a left adjustable receiver LR. As noted above, the left adjustable receiver LR can also be provided by simply reversing the orientation of the lead screw 34 (bolt 35) and nut 35*n* so that the head 35*h* lies adjacent the first side wall 12 of the base 10 instead of the second side wall 14 of the base 10 as shown in FIGS. 5A, 5B, and 5C that correspond respectively to FIGS. 4A, 4B, and 4C. FIG. 6 is similar to FIG. 5A but shows a lead screw 34' that is identical to the lead screw 34 except that it is formed with a left-hand thread such that clockwise rotation of the head 35*h* results in axial movement of the adjustment member 36 toward second side wall 24 and upward movement of the slide body 20 toward the base second end 10*b* and such that counter-clockwise rotation of the head 35*h* results in axial movement of the adjustment member toward the first side wall 22 and downward movement of the slide body 20 toward the base first end 10*a* for both the right adjustable receiver RR and the left adjustable receiver LR. By reversing the chirality or handedness of the lead screw 34,34', both the right adjustable receiver and left adjustable receiver can be manufactured with the same structure (except for the lead screw 34,34') and have the same operation with respect to clockwise and counter-clockwise rotation of the lead screw 34,34'. Alternatively, the right adjustable receiver RR can be installed and used as the left adjustable receiver LR without modification provided that the nut 35*n* is welded or otherwise be non-rotatable connected to the shank 35*s* so that the nut 35*n* can act as a driving head and be driven with a tool through the access opening AO in the left wall LW of the appliance body B.

The development has been described with reference to preferred embodiments, but it is not intended that the invention be limited to only the preferred embodiments. The following claims should be interpreted as broadly as possible while maintaining their validity.

The invention claimed is:

1. An adjustable appliance hinge receiver comprising:

a base including first and second lateral walls spaced apart by a front wall;

a slide body slidably connected to the base and located between the lateral walls of the base, said slide body adapted to slide relative to said base along an adjustment axis;

at least one hinge mounting structure connected to the slide body and adapted to be engaged by an associated hinge;

an adjustment system comprising:

a first inclined ramp connected to the slide body;

an adjustment shaft extending between and rotatably supported by the first and second lateral walls of the base, said adjustment shaft rotatable relative to said base about an axis of rotation;

an adjustment member engaged with the adjustment shaft and selectively movable axially along said axis of rotation in opposite first and second directions in response to rotational movement of the adjustment shaft about the axis of rotation in opposite first and second rotational directions such that rotation of said adjustment shaft in one of said first and second rotational directions causes said adjustment member to bear against said first ramp and induce sliding movement of said slide body relative to said base along said adjustment axis.

2. The adjustable appliance hinge receiver as set forth in claim 1, wherein said adjustment system further comprises a second inclined ramp connected to the slide body and spaced-apart from said first inclined ramp such that an adjustment channel is defined between the first and second inclined ramps.

3. The adjustable appliance hinge receiver as set forth in claim 2, wherein at least part of said adjustment member is located in said adjustment channel between said first and second inclined ramps.

4. The adjustable appliance hinge receiver as set forth in claim 3, wherein said adjustment shaft extends between said first and second lateral walls of the base through said adjustment channel defined between the first and second ramps.

5. The adjustable appliance hinge receiver as set forth in claim 4, wherein said slide body comprises first and second side walls, wherein:

said first inclined ramp is defined by a first tab portion of the first side wall of the slide body that is deflected toward the second side wall of the slide body; and, said second inclined ramp is defined by a second tab portion of the second side wall of the slide body that is deflected toward the first side wall of the slide body.

6. The adjustable appliance hinge receiver as set forth in claim 5, wherein said first and second side walls of the slide body comprise respective access openings defined by respective voids resulting from deflection of the first and second tab portions.

7. The adjustable appliance hinge receiver as set forth in claim 5, further comprising a support shaft that is connected to and extends between the first and second lateral walls of the base, wherein said support shaft inhibits rotation of said adjustment member about the axis of rotation of the adjustment shaft.

8. The adjustable appliance hinge receiver as set forth in claim 7, wherein said support shaft extends through the adjustment channel and is arranged parallel and spaced-apart with respect to the adjustment shaft.

9. The adjustable appliance hinge receiver as set forth in claim 8, wherein said adjustment member includes an aperture through which said support shaft extends, wherein said aperture comprises an aperture diameter and said support shaft comprises a shaft diameter that is smaller than said aperture diameter.

10. The adjustable appliance hinge receiver as set forth in claim 1, wherein said slide body comprises first and second side walls and wherein said at least one hinge mounting structure comprises a first mounting structure that is connected to and that extends between the first and second side walls of the slide body.

11. The adjustable appliance hinge receiver as set forth in claim 10, wherein said at least one hinge mounting structure further comprises a second mounting structure that is connected to and that extends between the first and second side walls of the slide body.

12. The adjustable appliance hinge receiver as set forth in claim 10, wherein said at least one hinge mounting structure further comprises a second mounting structure that is provided by a wall portion of said slide body.

13. The adjustable appliance hinge receiver as set forth in claim 1, wherein said base is connected to an appliance body.

14. The adjustable appliance hinge receiver as set forth in claim 1, wherein said adjustment shaft comprises a screw threadably engaged with said adjustment member.

15. An adjustable appliance hinge receiver comprising:

a base including spaced-apart first and second lateral walls;

a slide body slidably connected to the base and located between the lateral walls of the base, said slide body adapted to slide relative to said base along an adjustment axis;

at least one hinge mounting structure connected to the slide body and adapted to be engaged by an associated hinge;

an adjustment system comprising:

a first inclined ramp connected to the slide body;

a second inclined ramp connected to the slide body and spaced-apart from said first inclined ramp such that an adjustment channel is defined between the first and second inclined ramps;

an adjustment shaft extending between and rotatably supported by the first and second lateral walls of the base, said adjustment shaft rotatable relative to said base about an axis of rotation;

an adjustment member engaged with the adjustment shaft and selectively movable axially along said axis of rotation in opposite first and second directions in response to rotational movement of the adjustment shaft about the axis of rotation in opposite first and second rotational directions such that rotation of said adjustment shaft in one of said first and second rotational directions causes said adjustment member to bear against said first ramp and induce sliding movement of said slide body relative to said base along said adjustment axis;

wherein said first and second inclined ramps are arranged parallel with respect to each other and at least part of said adjustment member is located in said adjustment channel between said first and second inclined ramps.

16. An adjustable appliance hinge receiver comprising:

a base including spaced-apart first and second lateral walls;

a slide body slidably connected to the base and located between the lateral walls of the base, said slide body adapted to slide relative to said base along an adjustment axis;

at least one hinge mounting structure connected to the slide body and adapted to be engaged by an associated hinge;

an adjustment system comprising:

a first inclined ramp connected to the slide body;

an adjustment shaft extending between and rotatable supported by the first and second lateral walls of the base, said adjustment shaft rotatable relative to said base about an axis of rotation;

an adjustment member engaged with the adjustment shaft and selectively movable axially along said axis of rotation in opposite first and second directions in response to rotational movement of the adjustment shaft about the axis of rotation in opposite first and second rotational directions such that rotation of said adjustment shaft in one of said first and second rotational directions causes said adjustment member to bear against said first ramp and induce sliding movement of said slide body relative to said base along said adjustment axis;

wherein said first and second lateral walls of the base each comprise first and second elongated slots and wherein said slide body is slidably connected to the base by:

a first slide fastener that extends between the first elongated slot of the first lateral wall and the first elongated slot of the second lateral wall and that is engaged with the slide body; and a second slide fastener that extends between the second elongated slot of the first lateral wall and the second elongated slot of the second lateral wall and that is engaged with the slide body.

* * * * *